US006824072B2

(12) United States Patent
Minder

(10) Patent No.: US 6,824,072 B2
(45) Date of Patent: Nov. 30, 2004

(54) SPRAY GUN CLEANER

(76) Inventor: Darren R. Minder, 8 Evergreen La., Marlton, NJ (US) 08054

( * ) Notice: Subject to any disclaimer, the term of this patent is extended or adjusted under 35 U.S.C. 154(b) by 109 days.

(21) Appl. No.: 10/283,497

(22) Filed: Oct. 29, 2002

(65) Prior Publication Data

US 2004/0089740 A1 May 13, 2004

(51) Int. Cl.[7] ..... B05B 1/28
(52) U.S. Cl. ..... 239/104; 239/106
(58) Field of Search ..... 239/104, 106, 239/107, 110–113, 116, 118, 119, 122, 125, 124, 289, DIG. 14, 302–379; 134/102.1

(56) References Cited

U.S. PATENT DOCUMENTS 2,745,418 A * 5/1956 Balcom et al. ..... 134/102.1
6,179,222 B1 * 1/2001 Stecher ..... 239/112
6,488,216 B1 * 12/2002 Lewis ..... 239/106
6,520,190 B2 * 2/2003 Thompson et al. ..... 134/22.18
6,702,203 B2 * 3/2004 Jou ..... 239/346

* cited by examiner

*Primary Examiner*—Michael Mar
*Assistant Examiner*—Thach H. Bui
(74) *Attorney, Agent, or Firm*—Stuart M. Goldstein

(57) ABSTRACT

A spray gun cleaning system uses a separate cleaning fluid container which is substituted for the normal applied product container of the spray gun. The product feed tube of the spray gun is inserted into the cleaning fluid container, which is then sealably clamped to the spray cap of the spray gun. The container has a side opening, to which one end of a fluid hose is sealably attached. The other end of the hose is sealably attached to the nozzle portion of the spray gun. Pressurized air is discharged into the spray gun and this pressurization causes the cleaning fluid to circulate through the spray gun. As long as the pressurized air is discharged into the spray gun, cleaning fluid will automatically continue to circulate, without user involvement, through the sealed, closed circuit or path formed by the body of the spray gun, the fluid hose, the cleaning fluid container, and the feed tube. The cleaning system can thus automatically be allowed to operate as long as the user desires, in order to thoroughly clean the spray gun.

15 Claims, 3 Drawing Sheets

SPRAY GUN CLEANER

BACKGROUND OF THE INVENTION

It is common to use spray guns for applying primer, paint, varnishes, stains, and for other similar surface finishing products. Such spray gun devices routinely use pressurized air, discharged to and through the gun, into a container filled with the product to be applied, e.g. paint. The pressurized air forces the product through the nozzle of the spray gun for application.

However, when a particular job is finished or the type of applied product must be changed, e.g. using a different color paint, it is necessary that the internals of the spray gun be thoroughly cleaned. This ensures for its maintenance and extended work life, and provides that it will be in good condition for reuse. Moreover, there is nothing more frustrating to the user than having a solidified piece of the prior paint or other fluid residue break free from inside the gun, discharge through the nozzle, and spoil the finish of the work in progress.

There have been a number of prior attempts to clean spray guns. For instance, a common practice is to immerse a spray gun in a solvent or paint thinner. However, while some of the paint or fluid will be dislodged, much of it, especially inside the spray gun, will not. Some cleaning systems circulate solvent or other cleaning fluid through spray guns. Examples of such systems are found in U.S. Pat. Nos. 1,816,555, 4,746,063, and 5,855,218. However, the systems disclosed in these and other prior art have a number of significant disadvantages. For instance, such systems often are only designed to circulate solvent or cleaning fluid one time through the spray gun and then to discharge it into a separate receiving container. This has the obvious disadvantage of being an inefficient and wasteful use of cleaning fluid. There is also the burden of providing a separate recirculating system in which the cleaning fluid must be collected and then disposed of after the single pass. Given this limited circulation of cleaning fluid, such systems fail to completely clean the spray gun. Prior systems also must be constantly re-actuated and attended to by the user during the cleaning procedure. Significantly, none of the prior art systems automatically and continuously, without any user intervention, re-circulates cleaning fluid within a spray gun, to clean it thoroughly and completely.

SUMMARY OF THE INVENTION

It is thus an object of the present invention to provide a spray gun cleaning system which addresses these disadvantages and limitations of prior spray gun cleaning systems.

It is an object of the present invention to provide a spray gun cleaning system which thoroughly and completely cleans the internal surfaces of a spray gun.

It is a further object of the present invention to provide a spray gun cleaning system which efficiently and effectively cleans a spray gun with minimal user involvement.

It is another object of the present invention to provide a spray gun cleaning system which uses a minimal amount of solvent or other cleaning fluid to thoroughly clean a spray gun.

It is still another object of the present invention to provide a spray gun cleaning system which re-circulates solvent or other cleaning fluid for continuous flow through a spray gun within a closed pressurized circuit.

It is another object of the present invention to provide a spray gun cleaning system which, once activated, automatically and continuously cleans a spray gun without further user involvement.

It is a further object of the present invention to provide a spray gun cleaning system which can be used to clean a variety of different spray guns.

It is another object of the present invention to provide a spray gun cleaning system which can be used to clean a variety of paints, varnishes, stains, primers, or other application products used by spray guns.

These and other objects of the invention are provided by the spray gun cleaning system of the present invention. The system uses a separate cleaning fluid container which is substituted for the normal applied product container of the spray gun. The product feed tube of the spray gun is inserted into the cleaning fluid container, which is then sealably clamped to the spray cap of the spray gun. The container has a side opening, to which one end of a fluid hose is sealably attached. The other end of the hose is sealably attached to the nozzle portion of the spray gun. Pressurized air is discharged into the spray gun and this pressurization causes the cleaning fluid to circulate through the spray gun. As long as the pressurized air is discharged into the spray gun, cleaning fluid will automatically continue to circulate, without user involvement, through the sealed, closed circuit or path formed by the body of the spray gun, the fluid hose, the cleaning fluid container, and the feed tube. The cleaning system can thus automatically be allowed to operate as long as the user desires, in order to thoroughly clean the spray gun.

The novel features which are considered as characteristic of the invention are set forth in particular in the appended claims. The spray gun cleaning system device itself, however, both as to its design, construction, and use, together with additional features and advantages thereof, are best understood upon review of the following detailed description with reference to the accompanying drawings.

DETAILED DESCRIPTION OF THE INVENTION

Figure 1:
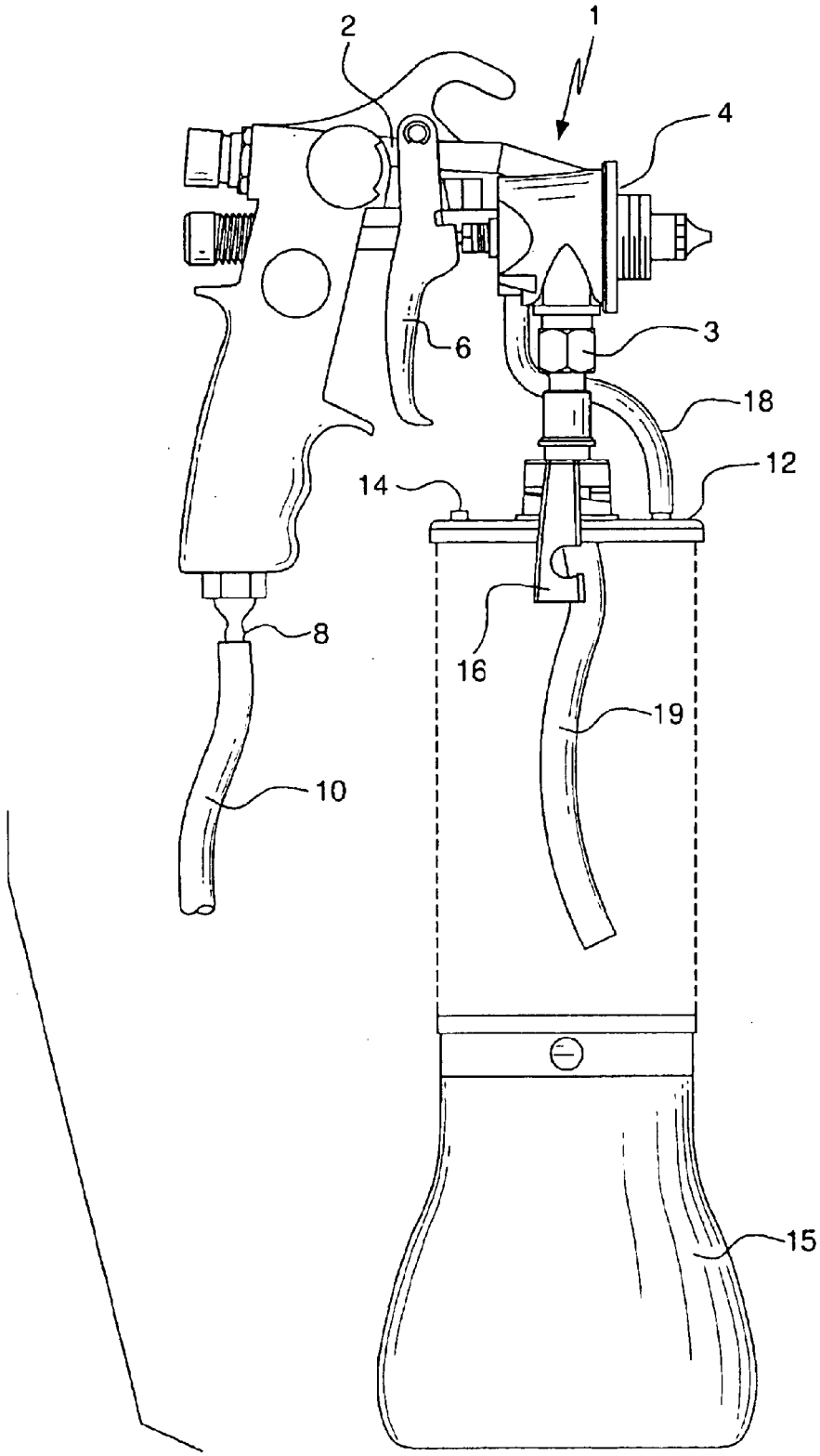
FIG. 1 shows a typical spray gun with its product container removed.
Figure 2:
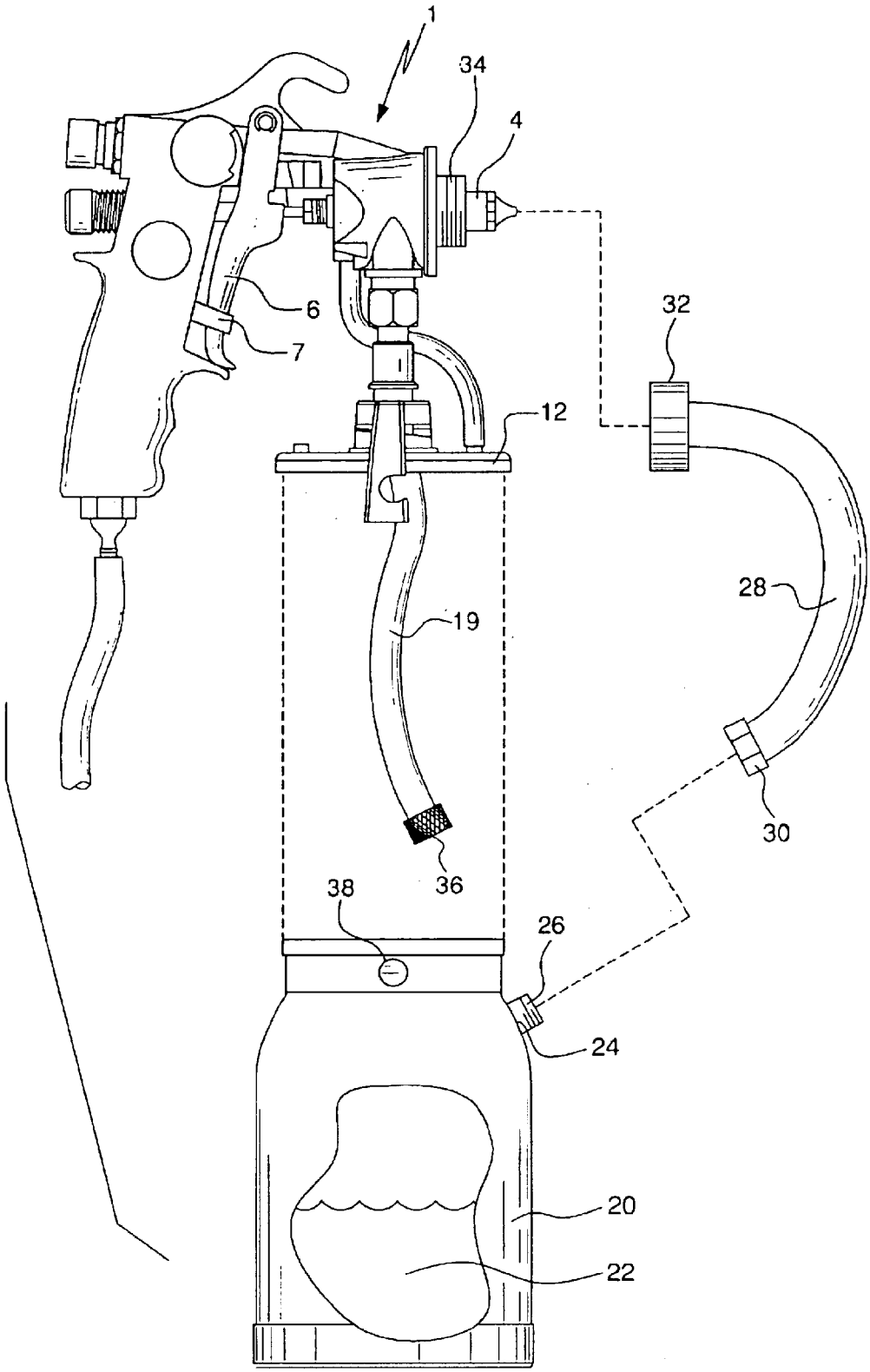
FIG. 2 shows, in exploded fashion, the components of the spray gun cleaning system of the invention and their positional relationship with the spray gun to be cleaned.

Spray gun 1 comprises body section 2, nozzle supply section 3, nozzle section 4, trigger actuator 6, and pressurized air or like fluid connection 8, for receiving pressurized fluid e.g. air, through line 10, via a pressurized source. Spray gun 1 also comprises spray cap 12 with pre-set pressure vent 14 and product feed tube 19 in the form of an intake stem or tube, extending therefrom. Spray cap 12 is configured to receive an applied product container 15 by means of clamp 16. Product container 15 is configured to enclose paint or other applied product. Line 18 supplies the pressurized air through spray cap 12 and into the product container. In normal use, the paint or other applied product is forced from product container 15 attached to spray cap 12, up through feed tube 19, through nozzle supply section 3, and out through nozzle section 4. Spray gun 1 in FIG. 1 is meant to show a typical spray gun. It should be understood that the subject invention is not restricted for use only on this specific design of spray gun, but is also adaptable for use on other types of spray guns employing similar components.

The spray gun cleaning system of the present invention comprises cleaning fluid container 20 typically filled approximately halfway with solvent or cleaning fluid 22. Container 20 has a side opening therethrough at 24, with a threaded male connection 26 extending outwardly from the opening. Fluid hose 28 has two ends, one end with threaded female connector 30 configured to be secured to connection 26 and second end with threaded female connector 32 configured to be secured to threaded male connector 34 located at nozzle section 4. Filter screen 36 is positioned over product feed tube 19.

Figure 3:
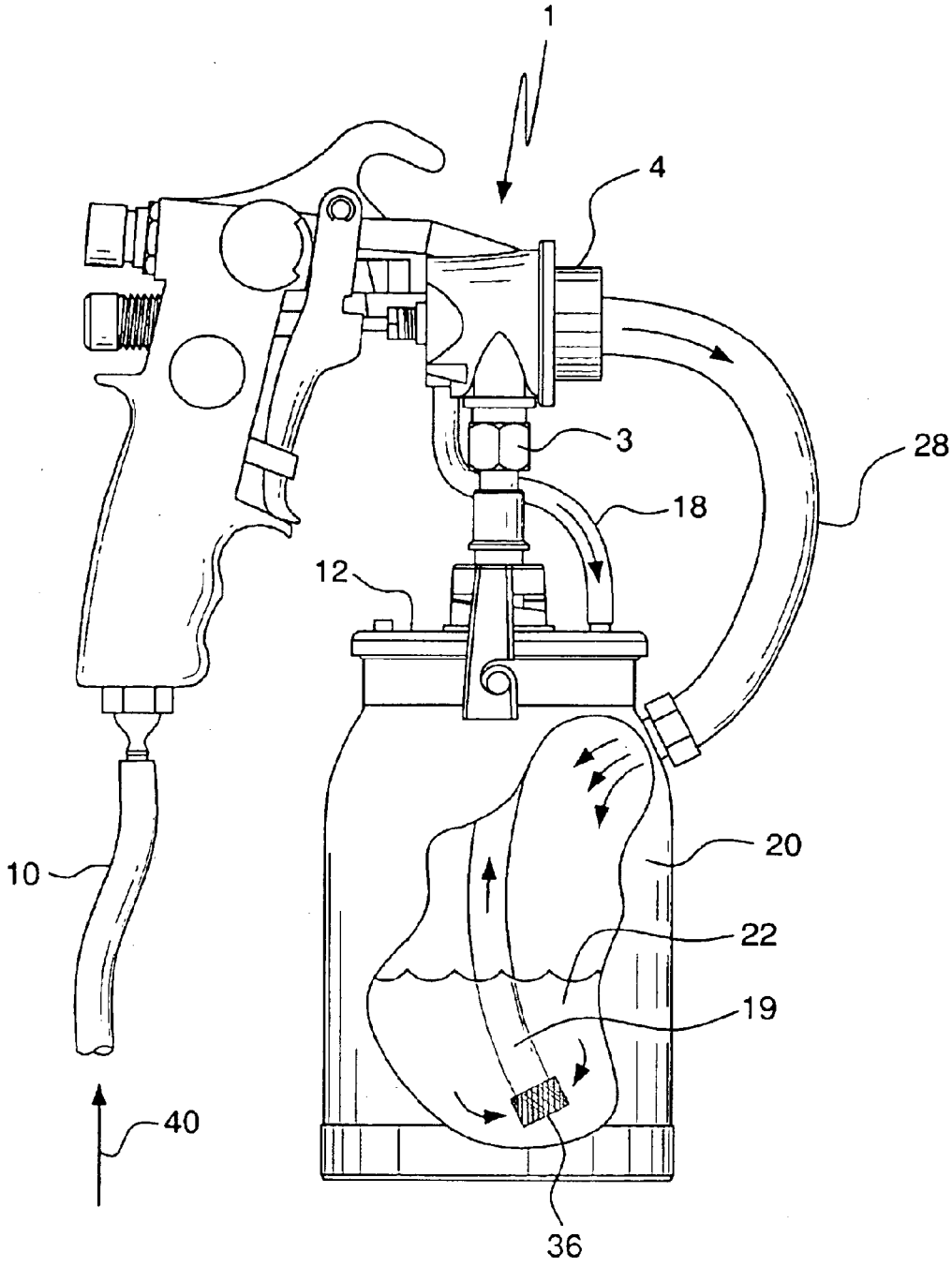
FIG. 3 shows the components of the cleaning system of the present invention in use on a spray gun.

In use, filter screen 36 is placed over product feed tube 19 and the feed tube is then positioned within cleaning fluid container 20. Container 20 is then connected to spray cap 12 by means of clamp 16 and its interconnection with knob 38 on the container. It is contemplated that container 20 will thus be sealingly pressure connected by use of appropriate gaskets, as is commonly known in the art. Fluid hose 28 is then tightly and sealingly secured via its connectors 30 and 32 to threaded connectors 26 and 34, respectively. Pressurized fluid, typically air, is then discharged through line 10 into spray gun 1, in the direction designated at 40. Trigger 6 is locked in an open position by removable bracket 7, allowing the pressurized air to flow through spray gun 1 and line 18. The pressurized air entering container 20, pressurizes the container. As shown in FIG. 3, this ultimately compels cleaning fluid 22 through filter screen 36 and up through feed tube 19. Cleaning fluid then travels passed spray cap 12 through spray gun nozzle supply section 3, out through nozzle section 4 to fluid hose 28, which acts as a conduit in returning the cleaning fluid to container 20. It can be appreciated that as the pressurized cleaning fluid rapidly flows through this closed, sealed circuit or path between container 20, feed tube 19, nozzle supply section 3, nozzle section 4, and fluid hose 28, the fluid contacts the paint or similar applied product on the inner surfaces of spray gun 1, thus cleaning these surfaces. With trigger 6 held in an open position, pressurized air constantly flows through spray gun 1. The rapid flow of pressurized air and cleaning fluid will continue within the closed path, automatically cleaning the spray gun, as long as pressurized air is discharged into the gun. Thus, a user desiring to thoroughly clean spray gun 1 can pressurize the spray gun with air, lock trigger 6 in an open position, and literally walk away while the cleaning fluid continues to be recycled and the spray gun is automatically cleaned.

When the user is satisfied that spray gun 1 has been sufficiently cleaned, he or she merely closes off the supply of pressurized air through line 10, disconnects fluid hose 28 from nozzle section 4 and de-clamps container 20 from spray cap 12. Spray gun 1 is thus ready to be used with a different paint or other applied product, upon attachment of another product container to spray cap 12.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A system for cleaning a pressurized fluid spray gun comprising a spray nozzle section, an applied product container, and a sealable spray cap, said system comprising:

(a) a separate container means for enclosing cleaning fluid, said container means configured to take the place of the product container and to be sealably secured to the spray cap of the spray gun;

(b) a container clamp which sealingly secures the container means to the spray cap; and (c) conduit means connected between the spray nozzle section and the container means for permitting the flow of cleaning fluid therethrough, whereby when pressurized fluid is discharged into the spray gun and as long as pressurized fluid is so discharged, a continuous, uninterrupted flow of cleaning fluid travels in a closed path through the conduit means, the container means, and the spray gun, thereby cleaning the spray gun.

2. The system as in claim 1 wherein the spray gun further comprises a product feed means which extends into the container means, the product feed means forming a part of the closed path through which cleaning fluid flows when pressurized fluid is discharged into the spray gun.

3. The system as in claim 1 wherein the conduit means is sealably connected between the spray nozzle section and an opening in the container means.

4. The system as in claim 2 wherein the product feed means is an intake stem.

5. The system as in claim 3 wherein the conduit means is a hose line.

6. The system as in claim 3 wherein the spray gun further comprises a product feed means which extends into the container means, the product feed means forming a part of the closed path through which cleaning fluid flows when pressurized fluid is discharged into the spray gun.

7. The system as in claim 6 wherein the product feed means is an intake stem.

8. The system as in claim 7 wherein the conduit means is a hose line.

9. The system as in claim 2 wherein the conduit means is sealably connected between the spray nozzle section and an opening in the container means.

10. The system as in claim 4 further comprising a filter screen which encompasses the open end of the intake stem.

11. A system for cleaning a pressurized fluid spray gun comprising a spray nozzle section, an applied product container, and a sealable spray cap, said system comprising:

(a) a separate container for enclosing cleaning fluid, said container configured to take the place of the product container and to be sealably secured to the spray cap of the spray gun, said cleaning fluid container further comprising an opening;

(b) a container clamp which sealingly secures the container to the spray cap; and (c) a fluid hose extending between the spray nozzle section and the cleaning fluid container and attachment means sealably connecting one end of the fluid hose to the spray nozzle section and the other end of the fluid hose sealably connected to the opening of the cleaning fluid container, whereby when pressurized fluid is discharged into the spray gun, and as long as pressurized fluid is so discharged, a continuous, uninterrupted flow of cleaning fluid travels in a closed path through the fluid hose, the cleaning fluid container, and the spray gun, thereby cleaning the spray gun.

12. The system as in claim 11 wherein the spray gun further comprises a product feed means which extends into the cleaning fluid container, the product feed means forming a part of the closed path through which cleaning fluid flows when pressurized fluid is discharged into the spray gun.

13. The system as in claim 12 wherein the product feed means is an intake stem.

14. The system as in claim 13 further comprising a filter screen which encompasses the open end of the intake stem.

15. A method of cleaning a pressurized fluid spray gun comprising a spray nozzle section, an applied product container, a sealable spray cap with a product feed line, and a container clamp, said method comprising the steps of:

(a) removing the product container from the spray cap of the spray gun;

(b) positioning the product feed line into a separate container enclosing cleaning fluid;

(c) sealably attaching the cleaning fluid container to the spray cap of the spray gun by securing the container clamp between the container and spray cap;

(d) sealably connecting a fluid hose line between the nozzle section of the spray gun and the cleaning fluid container;

(e) discharging pressurized fluid through the spray gun;

(f) establishing a continuous, uninterrupted flow of cleaning fluid traveling in a closed path comprising the fluid hose line, cleaning fluid container, product feed line, and the spray gun, as long as pressurized fluid is being discharged to the spray gun; and (g) continuing the discharge of pressurized fluid to the spray gun to automatically maintain the flow of cleaning fluid through the closed path.

* * * * *